US009780452B2

(12) United States Patent
Tanaka et al.

(10) Patent No.: US 9,780,452 B2
(45) Date of Patent: Oct. 3, 2017

(54) COMMUNICATION TERMINAL

(71) Applicant: SONY CORPORATION, Tokyo (JP)

(72) Inventors: Masato Tanaka, Chiba (JP); Shinichi Kuroda, Tokyo (JP); Takanori Nakazawa, Tokyo (JP)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 49 days.

(21) Appl. No.: 14/589,480

(22) Filed: Jan. 5, 2015

(65) Prior Publication Data

US 2016/0197407 A1 Jul. 7, 2016

(51) Int. Cl.

| | |
|---|---|
| ***H01Q 9/04*** | (2006.01) |
| ***H01Q 1/24*** | (2006.01) |
| ***H01Q 9/14*** | (2006.01) |
| ***H01Q 9/42*** | (2006.01) |
| ***H01Q 5/328*** | (2015.01) |

(52) U.S. Cl.

CPC ..... *H01Q 9/0407* (2013.01); *H01Q 1/243* (2013.01); *H01Q 5/328* (2015.01); *H01Q 9/145* (2013.01); *H01Q 9/42* (2013.01)

(58) Field of Classification Search

CPC ..... H01Q 1/243; H01Q 9/0407

USPC ..... 343/700 MS

See application file for complete search history.

(56) References Cited

U.S. PATENT DOCUMENTS

| | | | | |
|---|---|---|---|---|
| 2009/0273523 | A1* | 11/2009 | Sakuma | H01Q 1/243 343/700 MS |
| 2010/0134382 | A1 | 6/2010 | Liu et al. | |
| 2010/0188298 | A1* | 7/2010 | Suzuki | H01Q 9/0421 343/702 |
| 2010/0245201 | A1 | 9/2010 | Hossain et al. | |
| 2011/0227806 | A1* | 9/2011 | Wong | H01Q 1/243 343/848 |
| 2012/0119955 | A1* | 5/2012 | Milosavljevic | H01Q 1/243 343/702 |
| 2013/0016013 | A1* | 1/2013 | Wong | H01Q 1/243 343/700 MS |
| 2013/0201067 | A1 | 8/2013 | Hu et al. | |

(Continued)

FOREIGN PATENT DOCUMENTS

| | | |
|---|---|---|
| EP | 2 498 336 A2 | 9/2012 |
| EP | 2 731 194 A1 | 5/2014 |
| JP | 2008-219840 | 9/2008 |

OTHER PUBLICATIONS

Extended European Search Report issued Jun. 1, 2016 in Patent Application No. 15157717.8.

*Primary Examiner* — Dameon E Levi
*Assistant Examiner* — David Lotter
(74) *Attorney, Agent, or Firm* — Oblon, McClelland, Maier & Neustadt, L.L.P.

(57) ABSTRACT

Embodiments include a communication device, having a wireless communication processor. The communication device includes an antenna connected to a feeding point of the wireless communication processor. The communication device also includes a metal component disposed proximal the antenna and a circuit board including a ground plane. The communication device further includes a first conductive line and a second conductive line which connect the ground plane to two locations on the antenna, on one end and the other end of a location proximal the metal component.

23 Claims, 13 Drawing Sheets

(56) References Cited

U.S. PATENT DOCUMENTS

| | | | | |
|---|---|---|---|---|
| 2014/0078008 | A1* | 3/2014 | Kang | H01Q 5/35 343/702 |
| 2014/0132457 | A1* | 5/2014 | Galeev | H01Q 5/35 343/702 |
| 2015/0084817 | A1* | 3/2015 | Yong | H01Q 1/243 343/702 |

* cited by examiner

COMMUNICATION TERMINAL

FIELD OF THE DISCLOSURE

This disclosure generally relates to a communication terminal having a wireless communication processor and an antenna. More particularly, the present disclosure relates to a mobile telephone terminal, such as a smartphone, or the like having an antenna connected to a feeding point of the wireless communication processor with the antenna being isolated from interfering metal components of the mobile telephone terminal.

BACKGROUND

Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

In communication terminals, such as a smartphone, internal space is at a premium to maintain a preferred size of the communication terminal. Thus, each component within the communication terminal is disposed with high density within the casing of the communication terminal. Conventionally the communication terminal includes an antenna for performing wireless communications, however, the antenna may be disposed adjacent to other components which may cause interference with the antenna. For example, in a communication terminal, such as a smartphone, an antenna may be disposed in the lower part of the communication terminal casing near a universal serial bus (USB) port also disposed in the lower part of the casing for connecting to a USB plug. In such an example case, with the antenna being disposed close to the USB port, the antenna may experience degraded performance in that USB ports and plugs are metal components which may degrade or interfere with received or transmitted signals to and from the antenna.

SUMMARY

Embodiments include an antenna configuration including an antenna element connected to a feeding point. The antenna configuration also includes a first conductive line connecting a first point of the antenna element to ground. The antenna configuration further includes a second conductive line connecting a second point of the antenna element to ground. A distance between the first point and the second point of the antenna element is greater than a width of a metal component of a connection port.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 6 is a schematic view of the structure of a communication terminal according to a fourth embodiment of the disclosure.

DETAILED DESCRIPTION OF THE EMBODIMENTS

Figure 1:
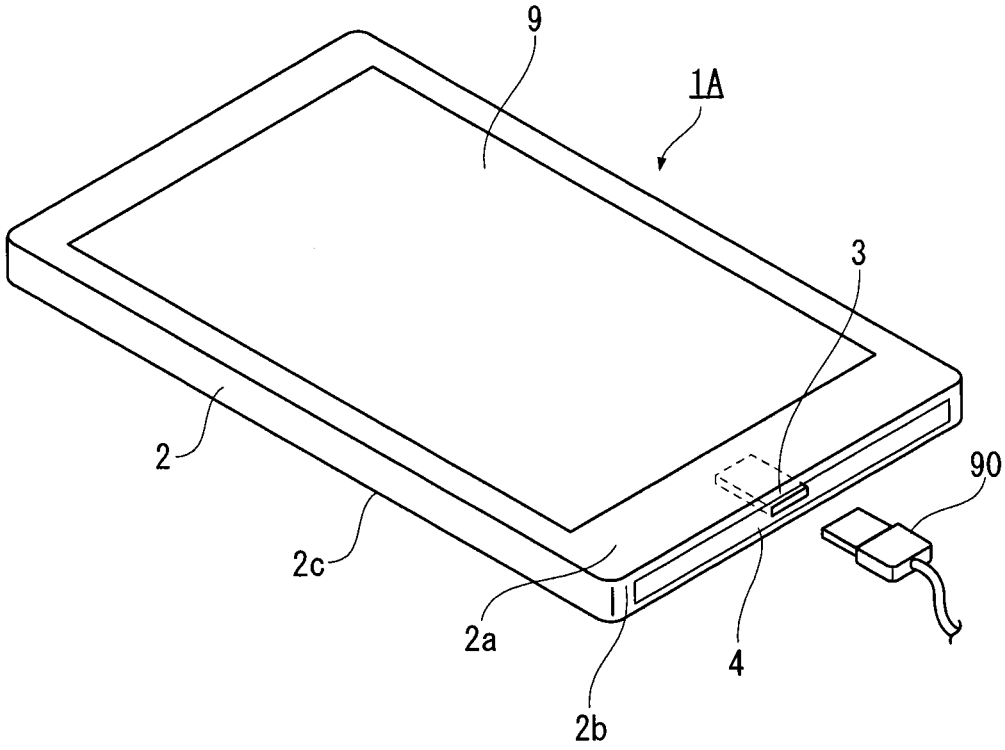
FIG. 1 is a perspective view of a communication terminal according to certain embodiments of the disclosure.

Referring now to the drawings, wherein like reference numerals designate identical or corresponding parts throughout the several views.

In a communication device, if metal a component, such as a USB port, a headphone jack, an HDMI port and/or the like, is disposed near an antenna, the characteristics of the antenna will be deteriorated. Thus, it is preferred that metal components are not disposed near the antenna. However, in many cases, metal components are disposed near the antenna in order to reduce the size of the communication device. According to the present disclosure, even in the case where metal components are disposed near the antenna, the characteristics of the antenna are prevented from being deteriorated and thus properly maintained.

FIG. 1 is a perspective view of the communication terminal 1A according to certain embodiments of the disclosure, for example a smartphone. In FIG. 1, communication terminal 1A includes a case 2, a display 9, a USB port 3, and an antenna 4. Examples of communication terminal 1A include a mobile phone, a smartphone, a tablet or the like. Display 9 is disposed in a front surface 2*a* of case 2. USB port 3 is disposed at the approximate center of a lower surface 2*b* of case 2. USB port 3 may include metal parts for mounting with a USB plug 90. USB port 3 is connected to a circuit board 5 (see FIG. 2) disposed inside case 2.

Also, antenna 4 is disposed at lower surface 2*b* of case 2. Antenna 4 includes a metal rod-shaped conductor. In addition, antenna 4 may be disposed on the surface of case 2 or inside case 2. When antenna 4 is disposed inside case 2, antenna 4 is arranged in a state which is not seen from the outer side of case 2.

USB port 3 and antenna 4 are arranged in a state which coincides with a thickness direction of case 2 at lower surface 2*b*, and are located in a position of about 1 millimeter (mm) apart.

In FIG. 1, USB port 3 is disposed at front surface 2*a* of case 2, and antenna 4 is disposed at a lower surface 2*b* of the case 2 as shown. Alternatively, USB port 3 and antenna 4 may be disposed in the reverse position. In some embodiments, antenna 4 may be configured to include an opening to accommodate USB port 3, as shown in FIG. 1. Antenna 4 is configured such that communication terminal 1A may perform wireless communications with a base station (not shown) for radio telephones. For example, two bands, a low band (700 MHz-900 MHz) and a high band (1500 MHz-2700 MHz), are selectively used for antenna 4, as it performs transmission and reception of a radio signal. As for the characteristic of antenna 4, any one or both of these, the low band and the high band may be set to the resonant frequency.

Figure 2:
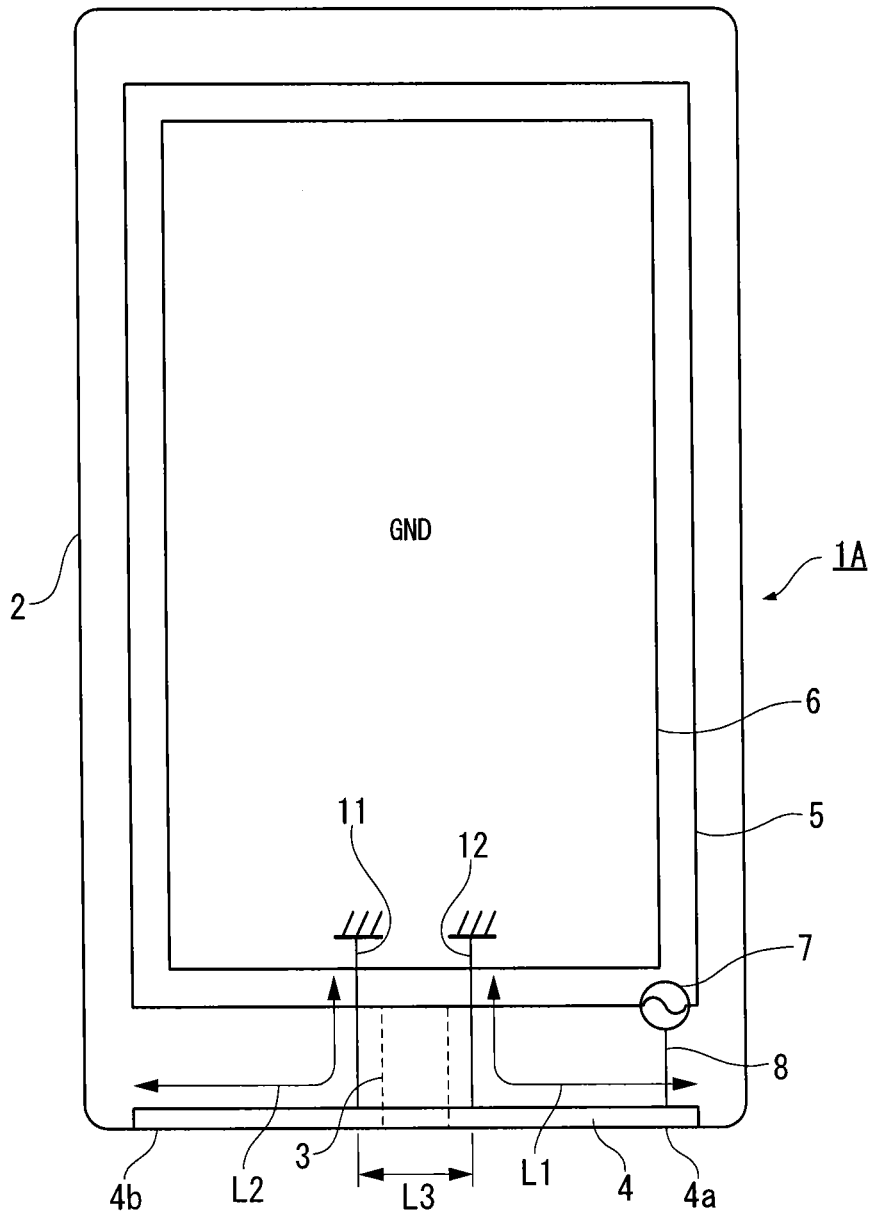
FIG. 2 is a schematic view of a connection state of an antenna of the communication terminal of FIG. 1 according to a first embodiment of the disclosure.

FIG. 2 is a schematic view of a signal connection state of antenna 4 of the communication terminal 1A of FIG. 1 according to a first embodiment of the disclosure. In the communication terminal 1A antenna 4 is connected to a feeding point 7. Antenna 4 is made of metal, such as good conductors, for example, silver, copper, aluminum, etc. Antenna 4 may have two locations respectively located near both lateral ends of the USB port 3 with these two locations being connected to a ground plane (GND) 6 of a circuit board 5 by two conductive lines 11, 12. The conductive lines 11, 12 are respectively located on opposing sides of a position where the antenna 4 and the USB port 3 are superimposed on each other. By connecting the antenna 4 to the ground plane 6 by the conductive lines 11, 12, no current will flow through a portion of the antenna between the conductive line 11 and the conductive line 12, and therefore antenna 4 is isolated from USB port 3, which is a metal component.

In FIG. 2, the antenna 4 includes a rod-shaped conductor having one edge portion 4*a* and another edge portion 4*b*. Portion 4*a* is connected to the feeding point 7 disposed through a conductive line 8 at the circuit board 5. The circuit board 5 is disposed inside communication terminal 1A, and the back surface of the circuit board 5 is configured as the ground plane (GND) 6. It should be noted that, the ground plane 6 is not limited to being located at the back surface, and any other suitable configurations may be adopted. For example, the ground plane 6 can be located at inside layer of communication terminal 1A. USB port 3 is disposed at the approximate center of the lower surface 2*b* of the case 2 is also connected to the circuit board 5. Antenna 4 is located adjacent to a first side of the USB port 3 and is connected to the ground plane 6 with the conductive line 11. Antenna 4 is also located adjacent to a second side of the USB port 3 and is connected to the ground plane 6 via the conductive line 12 (leaf spring etc.).

Antenna 4 shown in FIG. 2 operates as the reverse antenna of the front end load type which resonates by length L1 from the feeding point 7 to the connection part of the ground plane 6 of the conductive line 12, or a monopole type loop antenna. Also, the area from the connection part of the ground plane 6 of the conductive line 11 to the other edge portion 4*b* (open end) functions as a parasitic element which resonates by length L2. For this reason, when the antenna 4 transmits/receives the signal of the resonant frequency, an electric current flows into the area of length L1, and the area of length L2. Further, in this configuration an electric current will not flow into the area of length L3 between the connection point of the conductive line 11 of antenna 4, and the connection point of the conductive line 12. The area of length L3 of antenna 4 spans or by-passes USB port 3, and the USB plug 90 (see FIG. 1) which may be connected to USB port 3. In this case, since an electric current does not flow into the area of length L3, this current is not influenced at the time of transmission/reception of the antenna 4. In other words, antenna 4 is isolated from USB port 3 in this embodiment. Therefore, even if one closely arranges antenna 4 and USB port 3, the characteristic of antenna 4 does not deteriorate or degrade.

Figure 3:
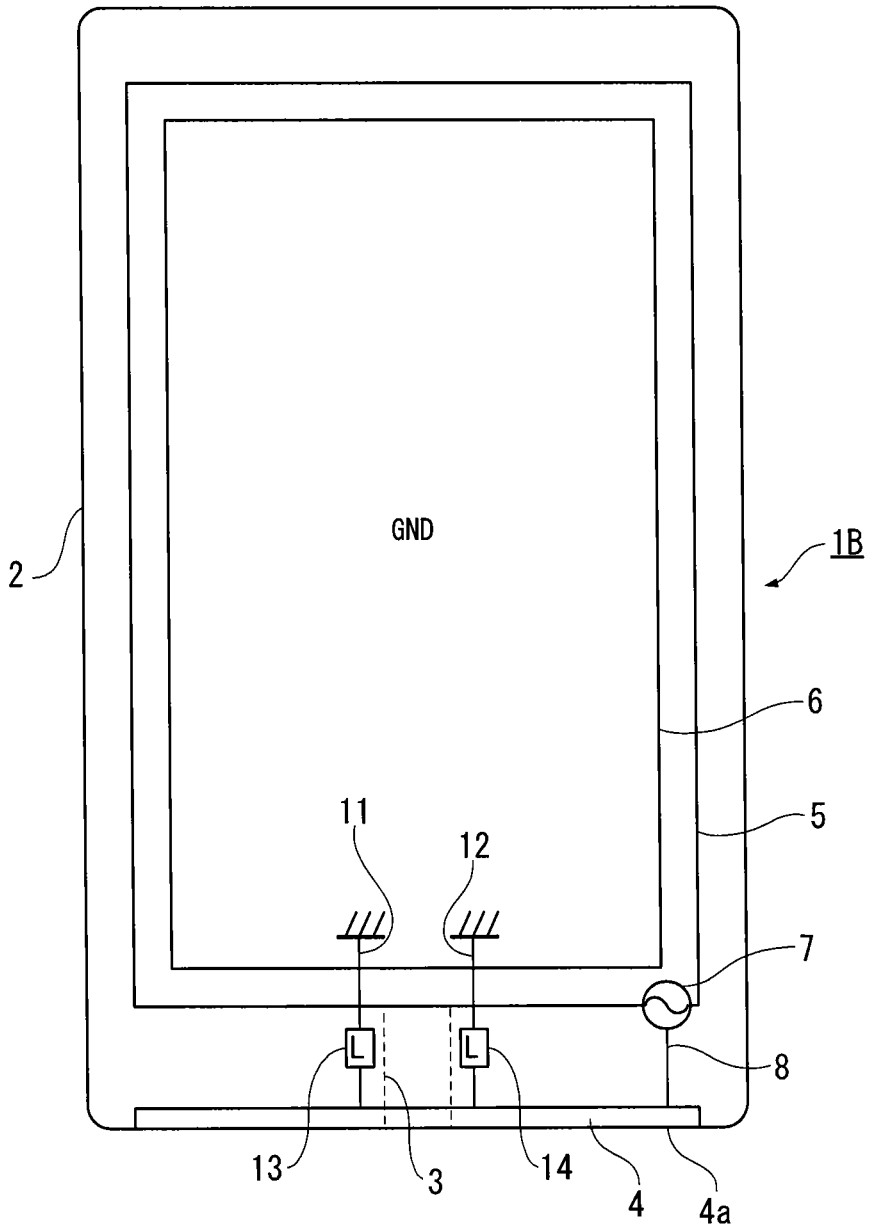
FIG. 3 is a schematic view of the structure of a communication terminal according to a second embodiment of the disclosure.

FIG. 3 is a schematic view showing the structure of a communication terminal 1B according to a second embodiment of the disclosure. In FIG. 3, the communication terminal 1B differs in the connection state of antenna 4 from communication terminal 1A of FIG. 2. In antenna 4, one edge portion 4*a* is connected to the feeding point 7 disposed at circuit board 5 through conductive line 8. Also, with respect to antenna 4, the location of a first side of USB port 3 is connected to ground plane 6 via conductive line 11. Furthermore, with respect to antenna 4, the location of a second side of USB port 3 is connected to ground plane 6 with conductive line 12. In addition, a coil 13 is connected in series with conductive line 11 and a coil 14 is connected in series with conductive line 12 within a series circuit. The coils 13 and 14 are inductors which control the electrical length from the feeding point 7 to the connection location of ground plane 6. As shown in FIG. 3, when the coils 13 and 14 are connected, antenna 4 is configured to make the resonating frequency lower than the resonant frequency decided by the length of physical L1, L2 (see FIG. 2). Because the electrical length gets longer due to the inductors, so, the resonating frequency drops to a lower value. Therefore, communication terminal 1B shown in FIG. 3 is configured to adjust the resonant frequency of antenna 4 with coils 13 and 14 disposed in series with conductive lines 11 and 12 in a series circuit, respectively.

Figure 4:
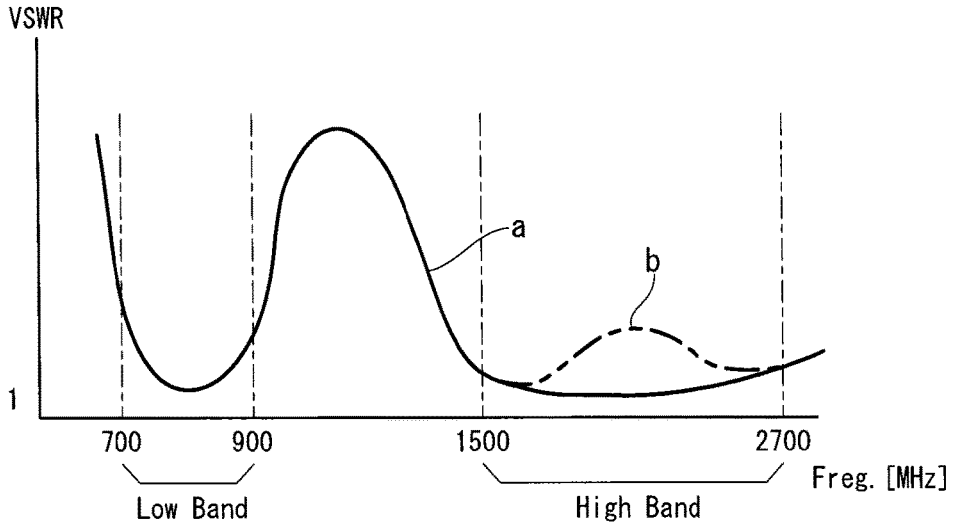
FIG. 4 is a frequency verses voltage standing wave ratio (VSWR) plot showing a characteristic curve of an antenna of the communication terminal of FIG. 3 according to certain embodiments of the disclosure.

FIG. 4 is a frequency verses voltage standing wave radio (VSWR) plot showing a characteristic curve of antenna 4 of communication terminal 1B according to certain embodiments of the disclosure. In FIG. 4, the horizontal axis shows frequency in megahertz (MHz), and the vertical axis shows a voltage standing wave ratio (VSWR). A value becomes large as the VSWR of the vertical axis goes to an upper side. In an apparatus treating a high frequency signal, it is required that the value of a VSWR should be low as much as possible. The theoretical minimum value of a VSWR is 1.0, and 1.5 or less may become a practical target.

A characteristic "a" shown in FIG. 4 is the characteristic of antenna 4 in the case where coils 13 and 14 are connected. Also, a characteristic "b" shown by a dashed-2 dotted line is the characteristic of antenna 4 in the case where coils 13 and 14 are not connected. As it may be understood, if these characteristics are compared, the characteristic "a" of antenna 4 is that for which coils 13 and 14 are connected, and the VSWR approximates to 1 in a high band range (1500 MHz-2700 MHz). Thus, FIG. 4 shows the principle of a change of a characteristic when coils 13 and 14 are connected to antenna 4, and does not show an exact VSWR.

Figure 5:
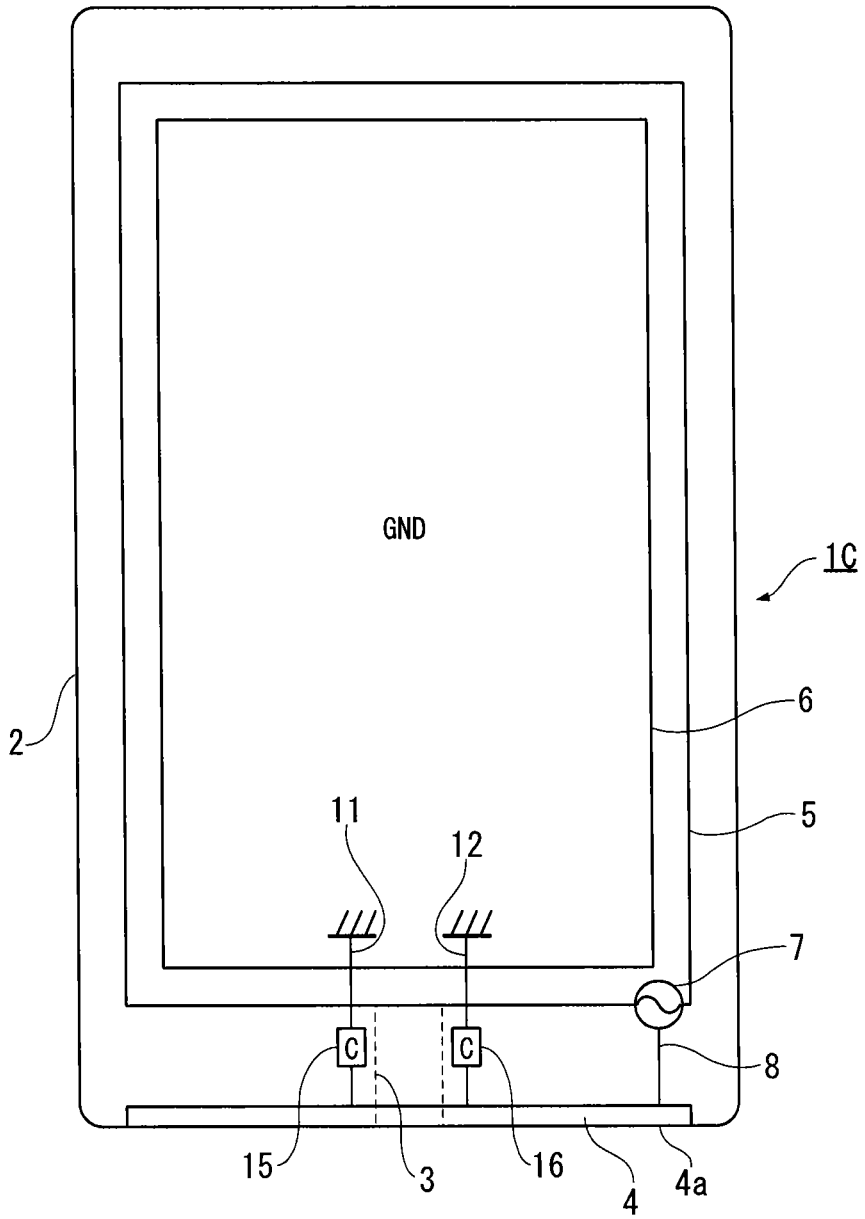
FIG. 5 is a schematic view of the structure of a communication terminal according to a third embodiment of the disclosure.

FIG. 5 is a schematic view of the structure of a communication terminal 1C according to a third embodiment of the disclosure. In FIG. 5, communication terminal 1C differs in the connection state of antenna 4 from communication terminals 1A and 1B. In antenna 4, one edge portion 4*a* is connected to feeding point 7 via conductive line 8 at circuit board 5. In addition, with respect to antenna 4, the location of a first side of USB port 3 is connected to ground plane 6 with conductive line 11. Furthermore, with respect to antenna 4, the location of a second side of USB port 3 is connected to ground plane 6 with conductive line 12. In this embodiment, a capacitor 15 is connected in series with conductive line 11. Further, a capacitor 16 is connected in series with conductive line 12 in a series circuit. Capacitors 15 and 16 are components which control the electrical length from feeding point 7 to the connection location of ground plane 6. As shown in FIG. 5, when capacitors 15 and 16 are connected, the frequency in which antenna 4 resonates is set into a frequency higher than the resonant frequency decided by the length of physical L1, L2 (see FIG. 2). Because the electrical length gets shorter due to the capacitors, so, the resonating frequency gets higher. Therefore, communication terminal 1C shown in FIG. 5 is configured to adjust the resonant frequency of antenna 4 via capacitors 15 and 16 disposed in series with conductive lines 11 and 12 in a series circuit, respectively.

Figure 6:
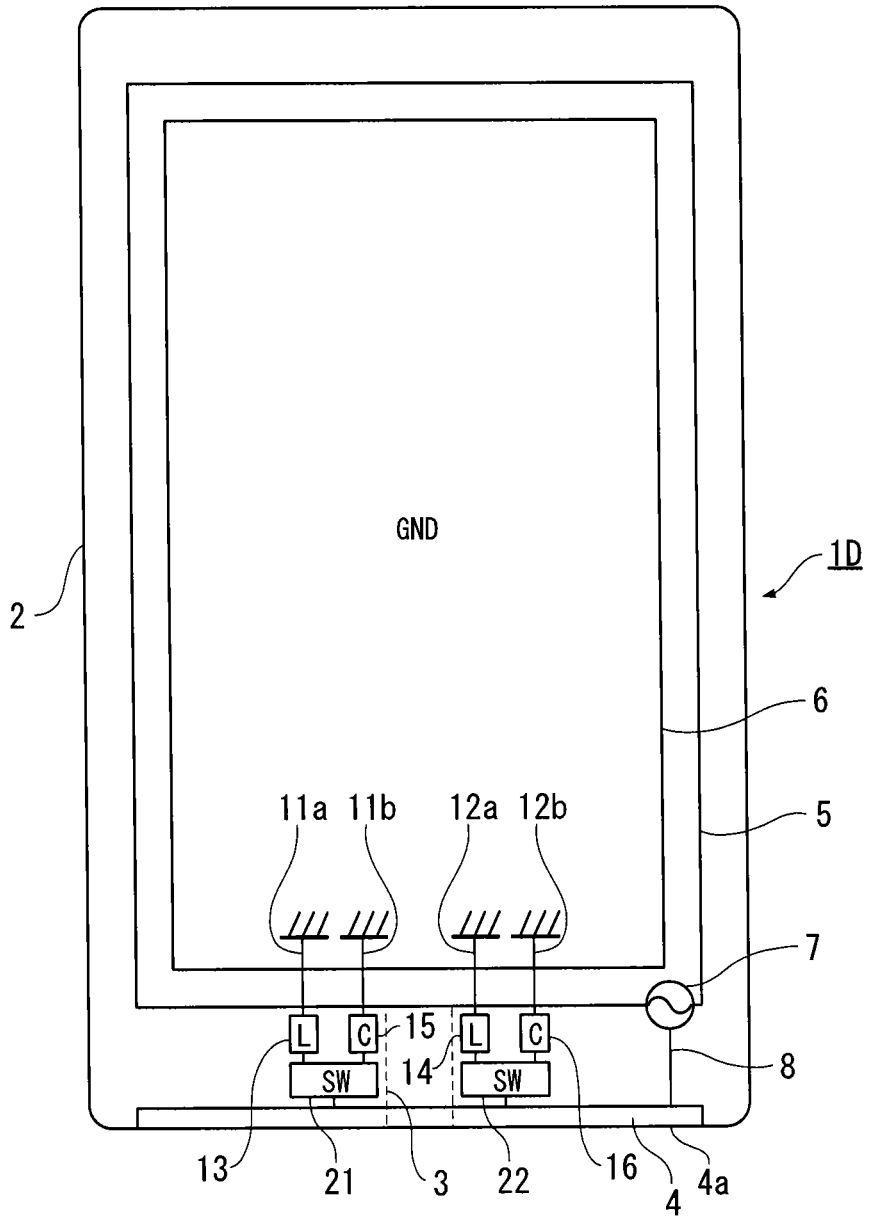
FIG. 6 is

FIG. 6 is a schematic view of the structure of communication terminal 1D according to a fourth embodiment of the disclosure. In FIG. 6, communication terminal 1D differs in the connection state of antenna 4 from communication terminal 1A, 1B and 1C. In antenna 4, one edge portion 4*a* is connected to feeding point 7 via conductive line 8 at circuit board 5. Also, with respect to antenna 4, the location of a first side of USB port 3 is connected to ground plane 6 by conductive lines 11*a*, 11*b*. Switch 21 is connected to antenna 4 of the location of the first side of USB port 3. Switch 21 is an element configured to select the channel of the conductive line 11*a*, and the channel of conductive line 11*b*. The channel of conductive line 11*a* is connected to ground plane 6 through coil 13. The channel of conductive line 11*b* is connected to ground plane 6 through capacitor 15.

Further, with respect to antenna 4, the location of a second side of USB port 3 is connected to ground plane 6 by conductive lines 12*a*, 12*b*. Switch 22 is connected to antenna 4 of the location of the second side of USB port 3. Switch 22 is an element configured to select the channel of conductive line 12*a*, and the channel of conductive line 12*b*. The channel of conductive line 12*a* is connected to ground plane 6 through coil 14. The channel of conductive line 12*b* is connected to ground plane 6 through capacitor 16. Switches 21, 22 are configured to activate and deactivate via a controller 160 (see FIG. 13) of communication terminal 1D.

Figure 7:
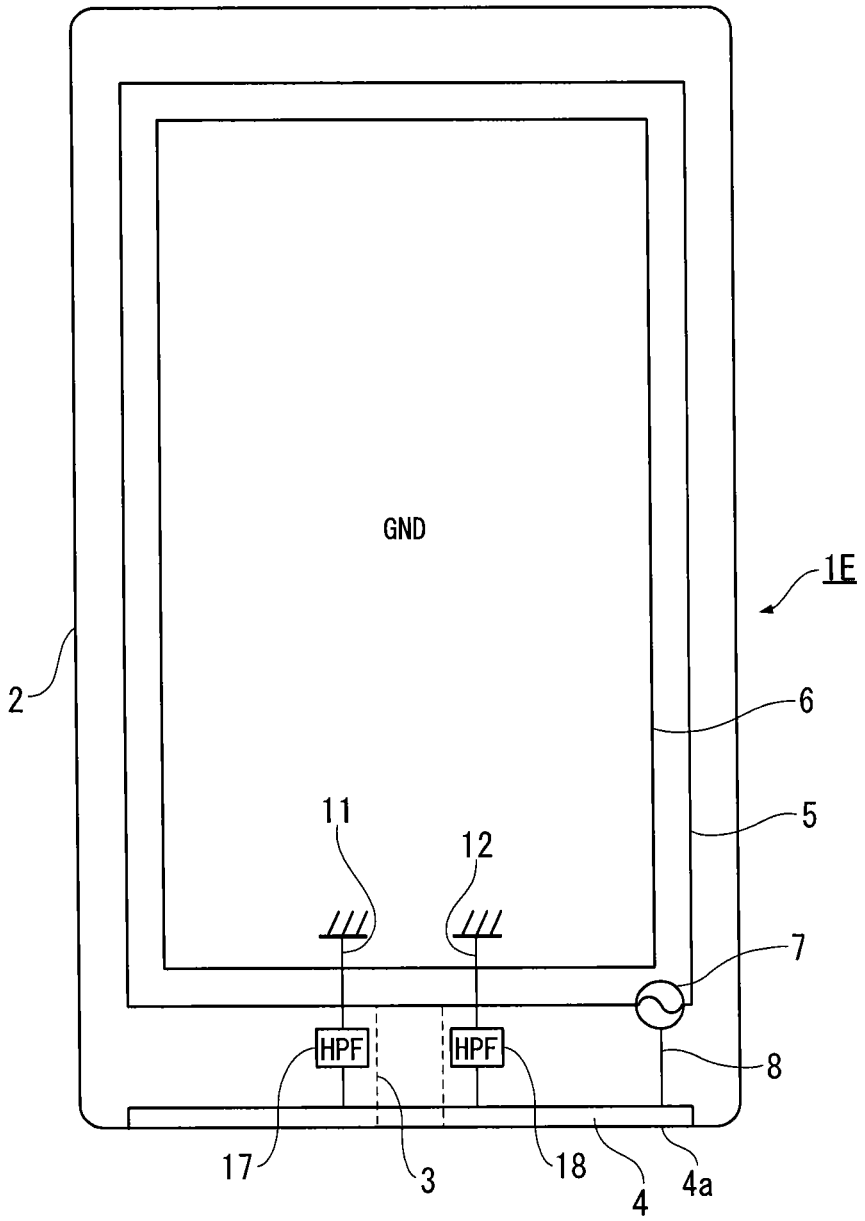
FIG. 7 is a schematic view of the structure of a communication terminal according to a fifth embodiment of the disclosure.

FIG. 7 is a schematic view of a structure of a communication terminal 1E according to a fifth embodiment of the disclosure. In FIG. 7, the communication terminal 1E differs in the connection state of antenna 4 from communication terminal 1A, 1B, 1C, and 1D. In antenna 4, one edge portion 4*a* is connected to feeding point 7 via conductive line 8 at circuit board 5. Also, with respect to antenna 4, the location of a first side of USB port 3 is connected to ground plane 6 with conductive line 11. Furthermore, with respect to antenna 4, the location of a second side of USB port 3 is connected to ground plane 6 with conductive line 12. A high-pass filter 17 is connected in series with conductive line 11 in a series circuit. Also, a high-pass filter 18 is connected in series with conductive line 12 in a series circuit. High-pass filters 17 and 18 are filters configured to allow a high band frequency to pass through and do not allow a low band frequency to pass through among the low bands and high bands (see FIG. 4) in which wireless communication processor 110 connected to antenna 4 transmits/receives. High-pass filters (or Band stop filters) 17 and 18 are comprised, for example by the parallel circuit of a capacitor and a coil/inductor. In this way, antenna 4 is not subject to the influence of USB port 3 with respect to the signal of a high band frequency by having connected antenna 4 to ground plane 6 through high-pass filters 17 and 18. In other words, as for the signal of a high band frequency, transmission/reception is not performed in the area between conductive line 11 and conductive line 12, the transmission/reception of a high band frequency where antenna 4 is not influenced by USB port 3 is attained. And the resonant frequency of antenna 4 is decided by length which divided antenna 4, and it comes to perform resonance suitable for a high band frequency.

On the other hand, since the signal of a low band frequency does not pass high-pass filters 17 and 18, antenna 4 functions as if it is not connected to ground plane 6.

Therefore, when antenna 4 transmits/receives the signal of a low band frequency, the appropriate transmission/reception which resonated with the low band using the whole length of that antenna 4 is attained. Thus, communication terminal 1E having antenna 4 is configured to perform favorable transmission/reception which is not influenced by USB port 3, and is configured to perform favorable transmission/reception in each band of a high band and a low band frequency.

Figure 8:
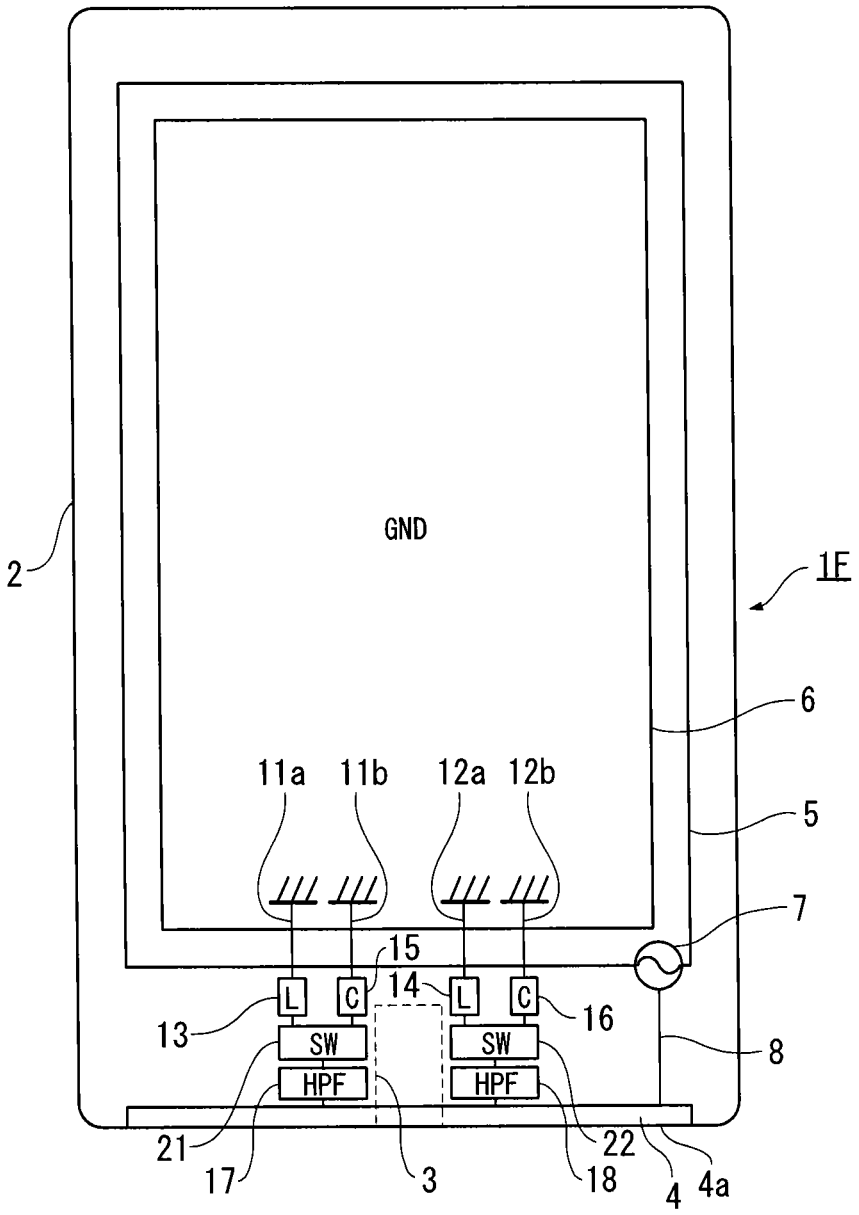
FIG. 8 is a schematic view of the structure of a communication terminal according to a sixth embodiment of the disclosure.

FIG. 8 is a schematic view of the structure of a communication terminal 1F according to a sixth embodiment of the disclosure. In FIG. 8, the communication terminal 1F combines high-pass filters 17 and 18 shown in FIG. 7 with antenna 4 of a structure of communication terminal 1D shown in FIG. 6. In other words, in antenna 4, one edge portion 4*a* is connected to feeding point 7 arranged at circuit board 5 via conductive line 8. Furthermore, with respect to antenna 4, the location of a first side of USB port 3 is connected to ground plane 6 through switch 21 and conductive lines 11*a*, 11*b*. High-pass filter 17 is connected in series with switch 21 and antenna 4 in a series circuit. The channel of conductive line 11*a* is connected to ground plane 6 through coil 13. The channel of conductive line 11*b* is connected to ground plane 6 through capacitor 15. In addition, with respect to antenna 4, the location of a second side of USB port 3 is connected to ground plane 6 through switch 22 and conductive lines 12*a*, 12*b*. High-pass filter 18 is connected in series with switch 22 and antenna 4 in a series circuit. The channel of conductive line 12*a* is connected to ground plane 6 through coil 14. The channel of conductive line 12*b* is connected to ground plane 6 through capacitor 16.

As FIG. 7 described, the characteristic of high-pass filters 17 and 18 is a filter which allows a high band to pass through and does not allow a low band to pass through among the low bands and high bands in which wireless communication processor 110 connected to antenna 4 transmits/receives. Switches 21, 22 activate in response to switching of the frequency which wireless communication processor 110 wirelessly communicates with a base station (not shown). This switching is performed when wireless communication processor 110 performs wireless communications using a high band.

Accordingly, communication terminal 1F is configured to transmit/receive a radio signal in the frequency band of both a high band and a low band, without being influenced by USB port 3 since it has high-pass filters 17 and 18. Furthermore, when using a high band, the antenna characteristics within a high band come to switch favorably because coils 13 and 14 and capacitors 15 and 16 energize or activate. Therefore, antenna 4 of communication terminal 1F performs transmission/reception of a radio signal more favorably.

Figure 9:
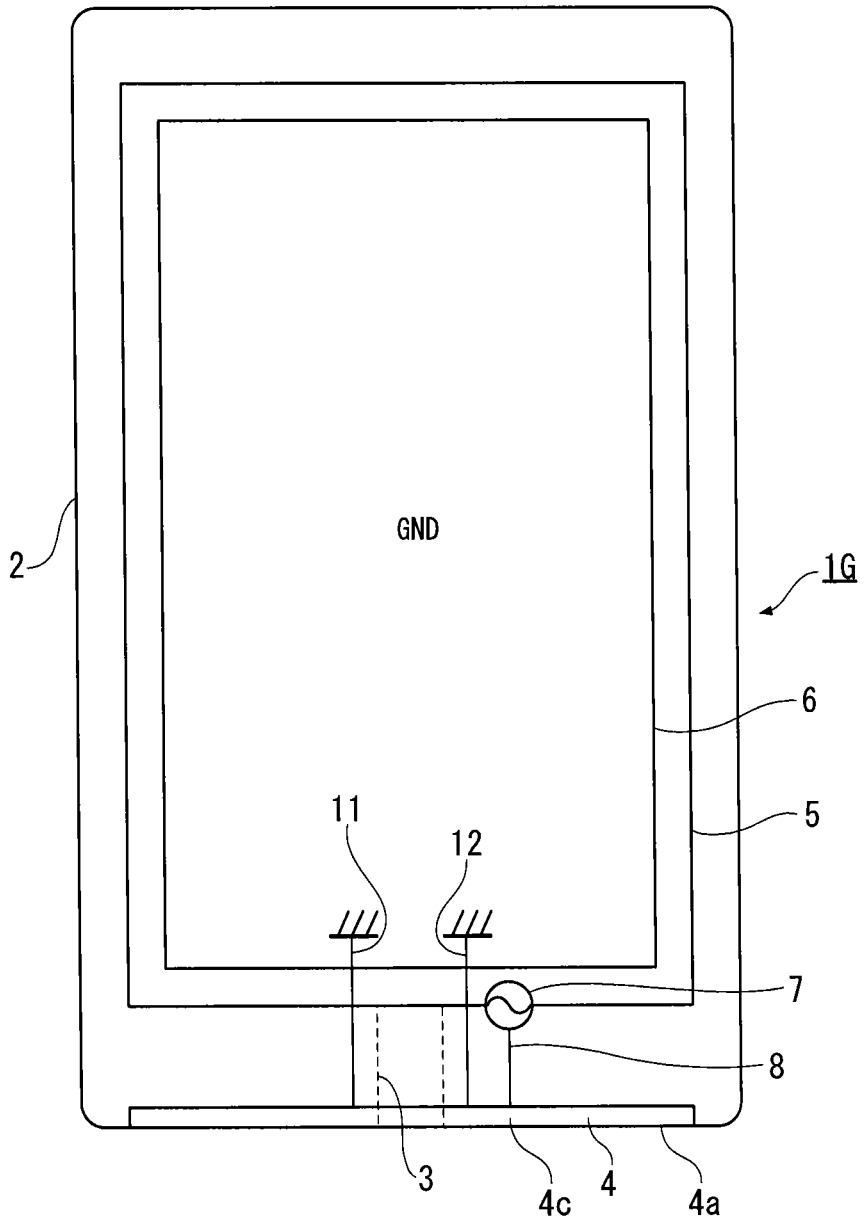
FIG. 9 is a schematic view of the structure of a communication terminal according to a seventh embodiment of the disclosure.

FIG. 9 is a schematic view of the structure of a communication terminal 1G according to a seventh embodiment of the disclosure. In FIG. 9, communication terminal 1G changes the position of feeding point 7 from antenna 4 of a structure of communication terminal 1A shown in FIG. 2. In antenna 4, the location adjacent to a first side of the USB port 3 is connected to ground plane 6 through conductive line 11. Furthermore, in antenna 4, the location adjacent to a second side of USB port 3 is connected to ground plane 6 through conductive line 12. Further, feeding point 7 of circuit board 5 is made into near-center position at 4*c* disposed proximal USB port 3 of communication terminal 1G. Feeding point 7 and antenna 4 are connected with conductive line 8. Conductive line 8 is arranged in the position adjacent to conductive line 12. Also, communication terminal 1G having antenna 4 is configured to perform transmission/reception of a radio signal in the characteristic similar to that of antenna 4 shown in FIG. 2.

Alternatively, when communication terminal 1G having antenna 4 as in the structure discussed above with respect to FIGS. 3-9 and for which each element (a coil, a capacitor, a high-pass filter) is connected to conductive lines 11 and 12 may be similarly combined.

Figure 10:
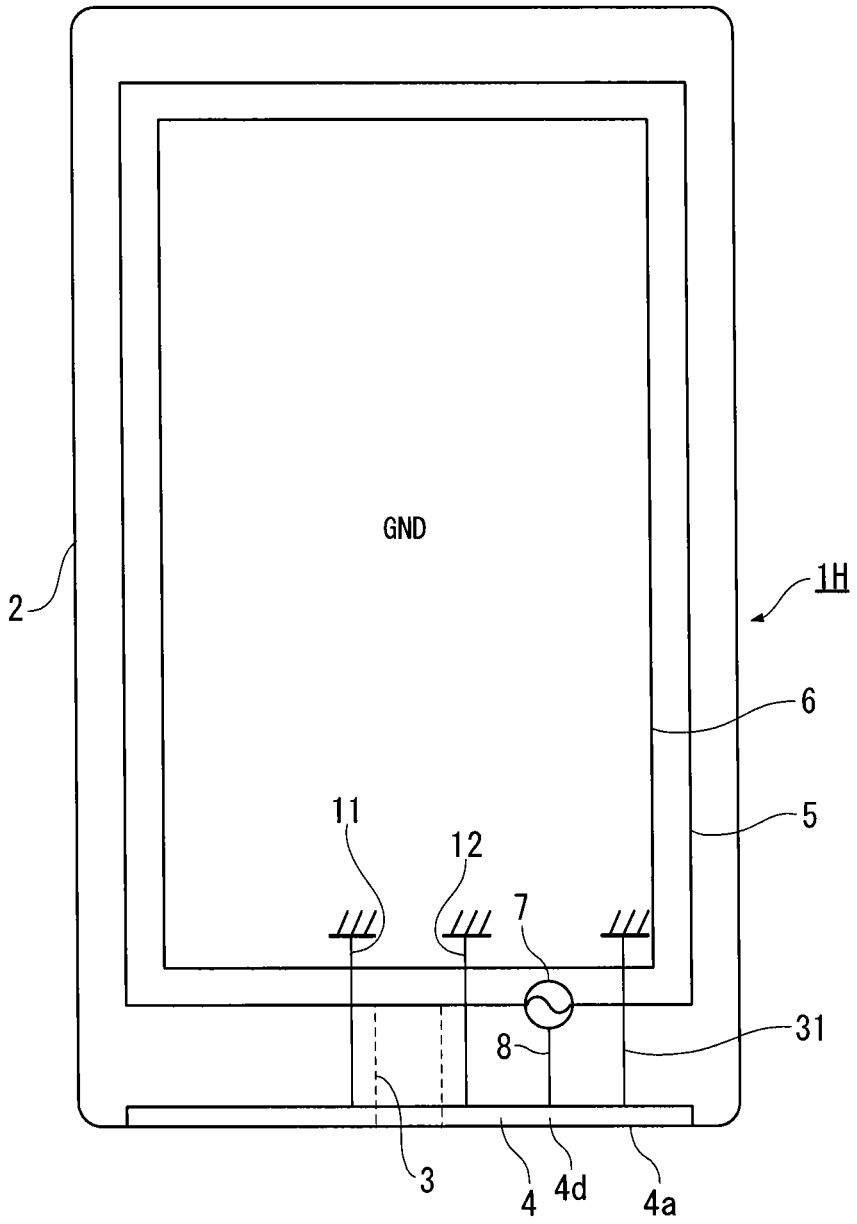
FIG. 10 is a schematic view of the structure of a communication terminal according to an eighth embodiment of the disclosure.

FIG. 10 is a schematic view of the structure of a communication terminal 1H according to an eighth embodiment of the disclosure. In FIG. 10, by way of example, communication terminal 1H is configured to increase the number of locations where antenna 4 is connected to ground plane 6. In antenna 4, the location adjacent to a first side of USB port 3 is connected to ground plane 6 through conductive line 11. Further, in antenna 4, the location adjacent to a second side of USB port 3 is connected to ground plane 6 via conductive line 12. Furthermore, as for antenna 4, one edge portion 4*a* is connected to ground plane 6 through conductive line 31.

In this embodiment, feeding point 7 of circuit board 5 may be disposed at a near-center position 4*d* of the lower end of the communication terminal 1H. Feeding point 7 and antenna 4 are connected with conductive line 8. Conductive line 8 is arranged in the position adjacent to conductive line 12.

Alternatively, communication terminal 1H having antenna 4 as in the structure discussed above with respect to FIGS. 3-9 and for which each element (a coil, a capacitor, a high-pass filter) is connected to conductive lines 11, 12, 31 may be similarly combined.

Figure 11:
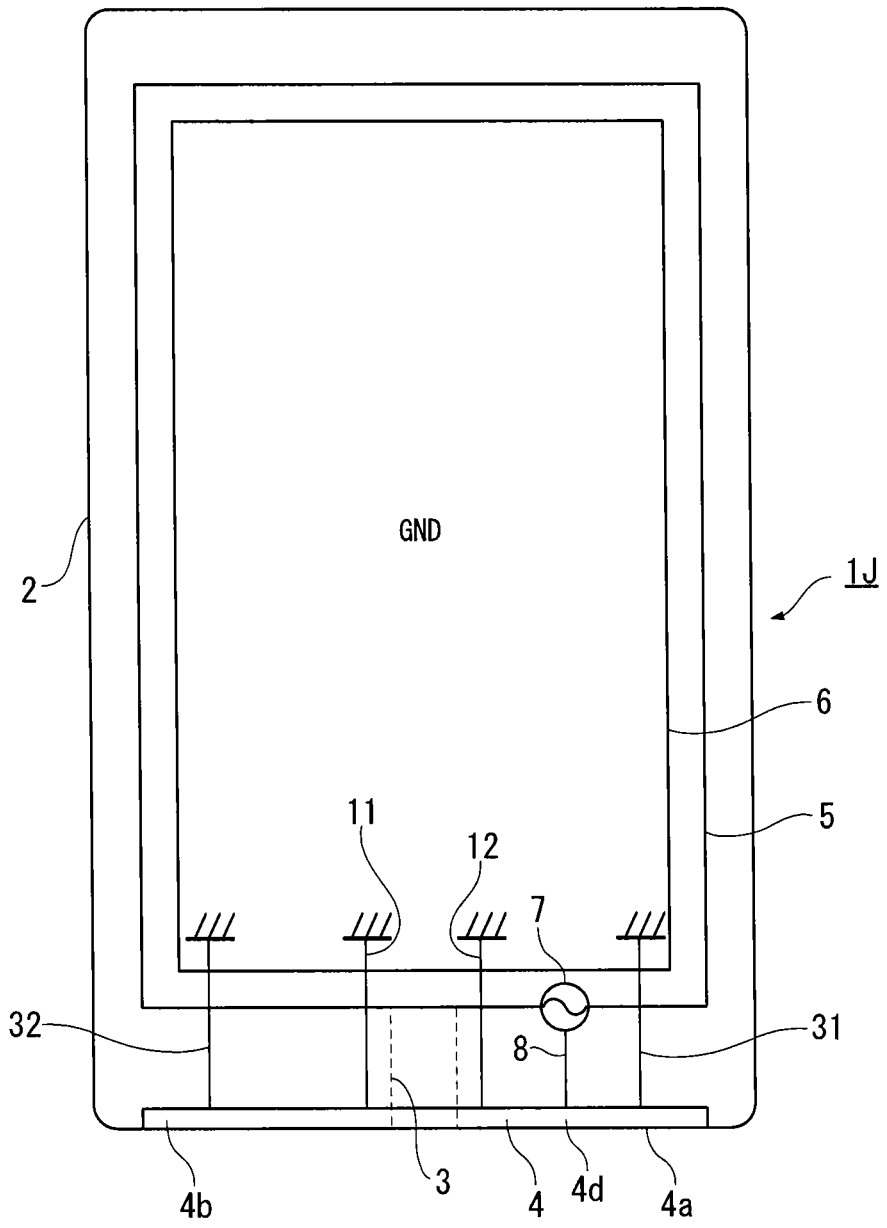
FIG. 11 is a schematic view of the structure of a communication terminal according to a ninth embodiment of the disclosure.

FIG. 11 is a schematic view of the structure of a communication terminal 1J according to a ninth embodiment of the disclosure. In FIG. 11, by way of example, communication terminal 1J is configured to increase the number of locations where antenna 4 is connected to ground plane 6 similar to the example of FIG. 10. In other words, with antenna 4, the location adjacent to a first side of USB port 3 is connected to ground plane 6 through conductive line 11. Also, with antenna 4, the location adjacent to a second side of USB port 3 is connected to ground plane 6 through conductive line 12. In addition, with respect to antenna 4, one edge portion 4*a* is connected to ground plane 6 through conductive line 31. Furthermore, with respect to antenna 4, the other edge portion 4*b* is connected to ground plane 6 through conductive line 32. In this embodiment, feeding point 7 of circuit board 5 may be disposed at a near-center position 4*d* of the lower end of communication terminal 1G. Feeding point 7 and antenna 4 are connected with conductive line 8. Conductive line 8 is arranged in the position adjacent to conductive line 12. Also, communication terminal 1J having antenna 4 is configured to perform transmission/reception of a radio signal in the characteristic similar to that of antenna 4 shown in FIG. 2.

Alternatively, communication terminal 1J having antenna 4 as in the structure discussed above with respect to FIGS. 3-9 and for which each element (a coil, a capacitor, a high-pass filter) is connected to conductive lines 11, 12, 31, 32 may be similarly combined.

Figure 12:
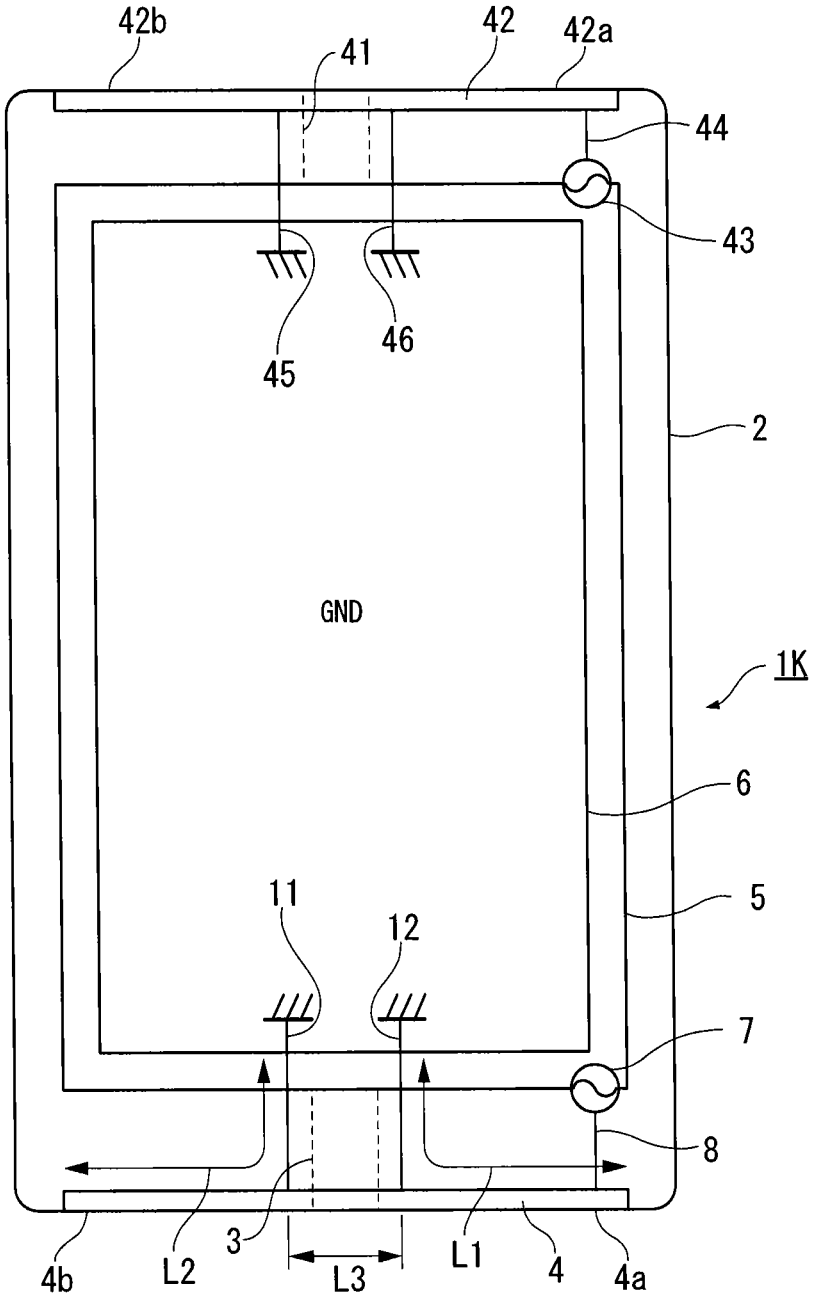
FIG. 12 is a schematic view of the structure of a communication terminal according to a tenth embodiment of the disclosure.

FIG. 12 is a schematic view of the structure of a communication terminal 1K according to a tenth embodiment of the disclosure. In FIG. 12, antenna 4 is disposed proximal lower surface 2*b* of case 2 of communication terminal 1K. The structure of antenna 4 is the same as antenna 4 shown in FIG. 2. In addition, communication terminal 1K includes an earphone jack 41 at an upper side approximate center. Earphone jack 41 may be a metal part and connected to circuit board 5. An earphone or a headset may be connected to earphone jack 41. In communication terminal 1K, a rod-shaped antenna 42 is proximately arranged to the upper side where earphone jack 41 is arranged. With regard to rod-shaped antenna 42, one edge portion 42*a* is connected to a feeding point 43 provided in circuit board 6 with a conductive line 44.

Further, with respect to antenna 42, the location of a first side of earphone jack 41 is connected to ground plane 6 through a conductive line 45. In addition, with respect to antenna 42, the location of a second side of earphone jack 41 is connected to ground plane 6 through conductive line 46. Antenna 42 is connected to the same wireless communication processor 110 as antenna 4 (see FIG. 13). An antenna with a favorable receiving characteristic may be used among the antenna 4 and the antenna 42. Also, the two antennas 4 and 42 may be simultaneously used for reception.

Antenna 42 shown in this FIG. 12 has the advantageous characteristic of not being influenced by earphone jack 41. In the case of antenna 42 shown in this FIG. 12. The structure which was discussed above with respect to in FIGS. 3-9 and for which each element (a coil, a capacitor, a high-pass filter) is connected to conductive lines 45 and 46 may be similarly combined. Further, with respect to antenna 42, the position connected to ground plane 6 may turn into a position similar to the position connected to antenna 4 shown in FIG. 10 and FIG. 11.

Antenna 4 shown in FIGS. 1-12 is configured into each embodiment as being disposed proximal to USB port 3. Alternatively, the above concepts and disclosures may be applied, for example, to antenna 4 disposed in the vicinity of a port of another telecommunications standard other than USB, such as a high definition multimedia interface (HDMI) port or the like. For instance, a communication terminal may be equipped with an HDMI port or the like which connects an external display with antenna 4 being disposed proximal to the HDMI port or the like.

Furthermore, this disclosure may be applied when metal parts other than a port or an earphone jack and an antenna are closely arranged. For example, an antenna may apply to the case arranged proximal to components, such as cell phone vibration motor, secure digital (SD) card port, or a speaker element. Also, this disclosure may be applied to an antenna disposed in locations in or on a communications terminal other than that of antenna 4 being disposed in or on the lower side at 2*b* as shown in FIGS. 1-12, and the antenna 42 being disposed in or on the upper side as shown in FIG.

12. For example, this disclosure may be applied when arranging an antenna at opposing ends of a communication terminal.

Furthermore, antenna 4 and antenna 42 are used as the antenna which performs wireless communications with the base station for radio telephones. On the other hand, this disclosure may be applied to other antennas, such as an antenna for wireless local area network (WLAN), an antenna for global navigation satellite system (GNSS) and an antenna for BLUETOOTH.

Therefore, an antenna having an optimal characteristic is obtained by selecting appropriately the constant of the element (a coil, a capacitor) connected to the antenna, and the connection position of the antenna and a ground plane. The characteristic and connection position of an element should be appropriately selected according to the structure of the case of a communication terminal, and the characteristic required for optimal transmission and reception.

Figure 13:
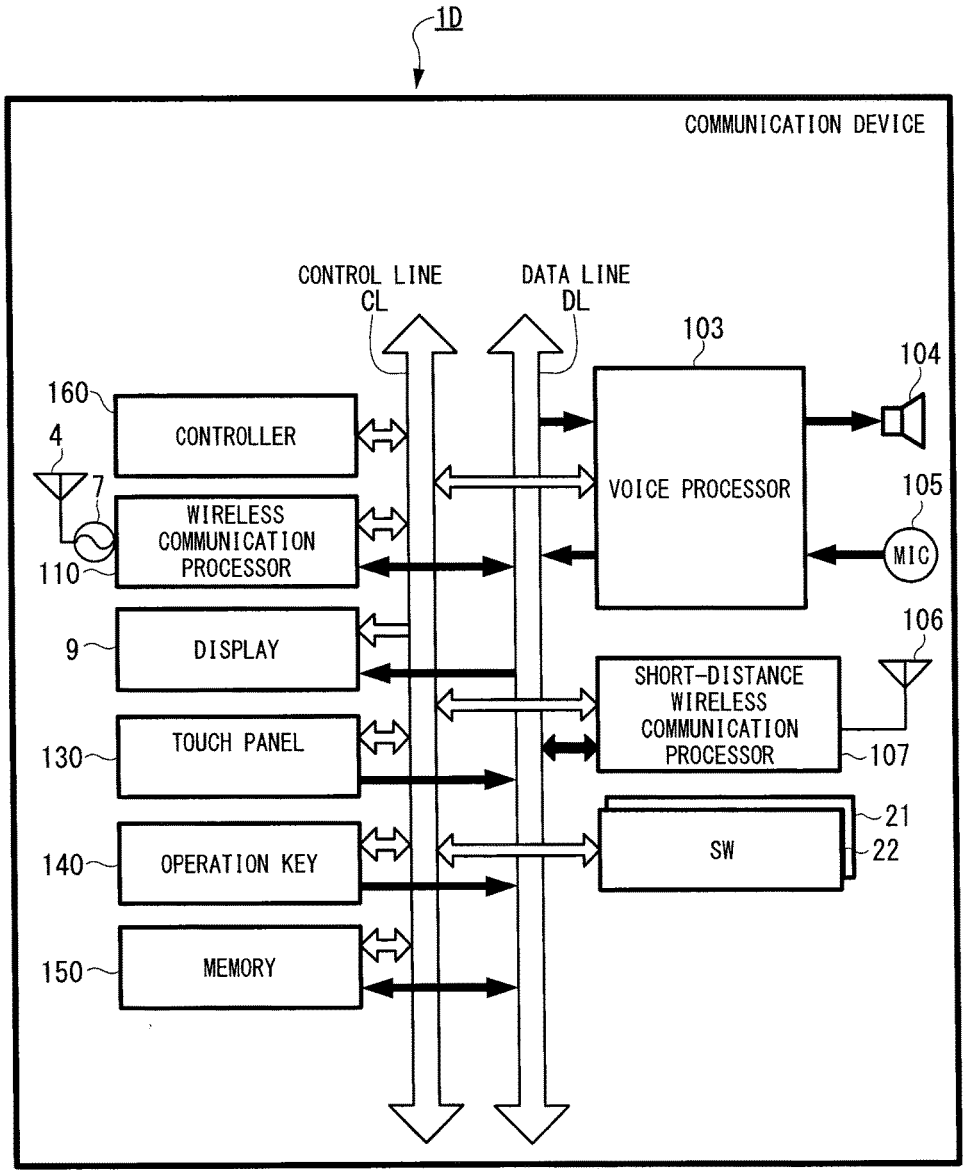
FIG. 13 is a block diagram illustrating a structural example of the communication terminal of FIG. 6 according to certain embodiments of the disclosure.

FIG. 13 is a block diagram illustrating a structural example of communication terminal 1D of FIG. 6 according to certain embodiments. In FIG. 13, communication terminal 1D, for example, may be equipped with antenna 4 for performing wireless communications with a base station (not shown) for radio telephones. Antenna 4 is connected to feeding point 7 of a wireless communication processor 110. A wireless communication processor 110 is configured to perform the process of transmission of a radio signal and reception under control of the controller 160.

Controller 160 may include, for example, a central processing unit (CPU). The control command output from controller 160 is transmitted to wireless communication processor 110 through a control line CL. Controller 160 is configured to read a program code stored on a memory 150 through the control line CL. Controller 160 controls each part of communication terminal 1D by running the read program. The voice data for a telephone call which wireless communication processor 110 receives are supplied to a voice processor 103 through a data line DL.

Voice processor 103 is configured to perform a demodulation process of the voice data supplied, and obtains an analog sound signal. The analog sound signal obtained in voice processor 103 is supplied to a speaker 104, and a sound is output from speaker 104. Also, voice processor 103 is further configured to convert into voice data of a transmission format the sound signal which a microphone 105 inputs. The voice data converted in voice processor 103 is supplied to wireless communication processor 110 through the data line DL. Also, the voice data supplied to wireless communication processor 110 are packeted and radio-transmitted. Optionally, when communication terminal 1D is not equipped with a voice call function, the components of voice processor 103, speaker 104, and microphone 105 may be omitted.

Communication terminal 1D may be equipped with a display 9. Display 9 is configured to perform presenting of an image or a variety of information to a display panel under control of controller 160. Display 9 may include a display panel, a liquid crystal display panel or an organic EL (Electro-Luminescence) display panel, for example.

In addition, communication terminal 1D may be equipped with the touchscreen or touch panel 130. When touched in the surface of a display panel with objects, such as a finger, pen or stylus, touch panel 130 is configured to detect a touch position. Touch panel 130 is configured as laminating on or integrating with a display panel.

Furthermore, communication terminal 1D may be equipped with an operation key 140. The operation information of operation key 140 is transmitted to controller 160. Further, communication terminal 1D includes a near field communication or short-distance wireless communication processor 107 to which an antenna 106 is connected. The short-distance wireless communication processor 107 is configured to perform near field communication with a proximal communication apparatus or an access point, such as a femtocell, picocell or microcell. Short-distance wireless communication processor 107 may be configured to apply the wireless LAN system specified, for example, as IEEE 802.11 standard, BLUETOOTH, etc., performs wireless communications with the other party within the range of about tens of meters to 2000 meters.

Also, communication terminal 1D may be equipped with switches 21, 22. Switches 21, 22 are configured to activate the conductive lines 11*a*, 12*a* and conductive lines 11*b*, 12*b*, as discussed above with regard to FIG. 6. Switches 21, 22 are switched by the control command which the controller 160 outputs. The activation of switches 21, 22 is performed in response to the switching of the frequency which wireless communication processor 110 wirelessly communicates with a base station (not shown).

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, define, in part, the scope of the foregoing claim terminology such that no inventive subject matter is dedicated to the public.

The above disclosure also encompasses the embodiments noted below.

(1) An antenna configuration comprising: an antenna element connected to a feeding point; a first conductive line connecting a first point of the antenna element to ground; and a second conductive line connecting a second point of the antenna element to ground, wherein a distance between the first point and the second point of the antenna element is greater than a width of a metal component of a connection port.

(2) The antenna configuration according to (1), wherein the connection port is a universal serial bus (USB) port.

(3) The antenna configuration according to (1) or (2), wherein the connection port is an earphone jack.

(4) The antenna configuration according to any one of (1) to (3), wherein the connection port is a high definition multimedia interface (HDMI) port.

(5) The antenna configuration according to any one of (1) to (4), wherein the first conductive line and the second conductive line each have a coil connected thereto.

(6) The antenna configuration according to any one of (1) to (5), wherein the first conductive line and the second conductive line each have a capacitor connected thereto.

(7) The antenna configuration according to any one of (1) to (6), wherein the first conductive line and the second conductive line each have a coil and a capacitor connected thereto in a series circuit where the coil and the capacitor are configured to be selectively activated via a switch.

(8) The antenna configuration according to any one of (1) to (7), wherein the first conductive line and the second conductive line each have a high-pass filter connected thereto.

(9) The antenna configuration according to any one of (1) to (8), wherein the first conductive line and the second conductive line each have a series circuit connected thereto, wherein the series circuit is comprised of a high-pass filter and a coil or a capacitor.

(10) The antenna configuration according to any one of (1) to (9), wherein the feeding point is disposed at a position farthest from the points of the antenna element where the first and second conductive lines are connected.

(11) The antenna configuration according to any one of (1) to (10), further comprising: a third conductive line connecting a third point of the antenna element to ground.

(12) The antenna configuration according to any one of (1) to (11), wherein the antenna element is configured as a BLUETOOTH connection.

(13) The antenna configuration according to any one of (1) to (12), wherein the antenna element is configured as a wireless local area network (LAN) connection.

(14) The antenna configuration according to any one of (1) to (13), wherein the antenna element is configured as a global navigation satellite system (GNSS) connection.

(15) The antenna configuration according to any one of (1) to (14), wherein the first conductive line and the second conductive line each have a coil and a capacitor connected thereto in a series circuit where the coil and the capacitor are configured to be selectively activated via a switch, and wherein the switch further is connected to a high-pass filter.

(16) The antenna configuration according to any one of claims (1) to (15), further comprising: a second antenna element connected to a second feeding point; a third conductive line connecting a first point on the second antenna element to ground; and a fourth conductive line connecting a second point on the second antenna element to ground, wherein a distance between the first point and the second point of the second antenna element is greater than a width of a second metal component of a second connection port.

(17) The antenna configuration according to any one of (1) to (16), wherein the second connection port is a universal serial bus (USB) port.

(18) The antenna configuration according to any one of (1) to (17), wherein the second connection port is an earphone jack.

(19) The antenna configuration according to any one of (1) to (18), wherein the second connection port is a secure digital (SD) card port.

(20) The antenna configuration according to any one of (1) to (19), wherein the second metal component is a speaker element.

(21) The antenna configuration according to any one of (1) to (20), wherein the second metal component is a vibration motor.

The invention claimed is:

1. An electronic device comprising:

a connection port configured to receive an external connector;

an antenna element connected to a feeding point, at least a portion of the antenna element overlapping the connection port;

a first conductive line connecting a first point of the antenna element to a ground plane; and a second conductive line connecting a second point of the antenna element to the ground plane, wherein a distance between the first point and the second point of the antenna element is greater than a width of the connection port, the ground plane does not overlap with the connection port in a top plan view of the electronic device, and the first conductive line is connecting the first point of the antenna element to the ground plane on one side of the connection port in the top plan view, and the second conductive line is connecting the second point of the antenna element to the ground plane on the other side of the connection in the top plan view such that the connection portion is provided between the first conductive line and the second conductive line in the top plan view.

2. The electronic device according to claim 1, wherein the connection port is a universal serial bus (USB) port.

3. The electronic device according to claim 1, wherein the connection port is an earphone jack.

4. The electronic device according to claim 1, wherein the connection port is a high definition multimedia interface (HDMI) port.

5. The electronic device according to claim 1, wherein the first conductive line and the second conductive line each have a coil connected thereto.

6. The electronic device according to claim 1, wherein the first conductive line and the second conductive line each have a capacitor connected thereto.

7. The electronic device according to claim 1, wherein the first conductive line and the second conductive line each have a coil and a capacitor connected thereto in a series circuit where the coil and the capacitor are configured to be selectively activated via a switch.

8. The electronic device according to claim 1, wherein the first conductive line and the second conductive line each have a high-pass filter connected thereto.

9. The electronic device according to claim 1, wherein the first conductive line and the second conductive line each have a series circuit connected thereto, wherein the series circuit is comprised of a high-pass filter and a coil or a capacitor.

10. The electronic device according to claim 1, wherein the feeding point is disposed at a position farthest from the points of the antenna element where the first and second conductive lines are connected.

11. The electronic device according to claim 1, further comprising:

a third conductive line connecting a third point of the antenna element to ground.

12. The electronic device according to claim 1, wherein the antenna element is configured as a BLUTOOTH connection.

13. The electronic device according to claim 1, wherein the antenna element is configured as a wireless local area network (WLAN) connection.

14. The electronic device according to claim 1, wherein the antenna element s configured as a global navigation satellite system (GNSS) connection.

15. The electronic device according to claim 1, wherein the first conductive line and the second conductive line each have a coil and a capacitor connected thereto in a series circuit where the coil and the capacitor are configured to he selectively activated via a switch, and wherein the switch further is connected to a high-pass filter.

16. The electronic device according to claim, further comprising:

a second connection port;

a second antenna element connected to a second feeding point;

a third conductive line connecting a first point on the second antenna element to ground; and a fourth conductive line connecting a second point on the second antenna element to ground, wherein a distance between the first point and the second point of the second antenna element is greater than a width of the second connection port.

17. The electronic device according to claim 16, wherein the second connection port is a universal serial bus (USB) port.

18. The electronic device according to claim 16, wherein the second connection port is an earphone jack.

19. The electronic device according to claim 16, wherein the second connection port is a secure digital (SD) card port.

20. An electronic device comprising:

a connection port configured to receive an external connector;

an antenna element at least partially overlapping the connection port;

a feeding point connected to the antenna element;

a first conductive line connecting a first point of the antenna element located at a first distance from a first end of the antenna element to a ground plane; and a second conductive line connecting a second point of the antenna element located at a second distance from a second end of the antenna element to the ground plane, wherein a distance between the first point of the antenna element and the second point of the antenna element is greater than a width of the connection port, the ground plane does not overlap with the connection port in a top plan view of the electronic device, and the first conductive line is connecting the first point of the antenna element to the ground plane on one side of the connection port in the top plan view, and the second conductive line is connecting the second point of the antenna element to the ground plane on the other side of the connection in the top plan view such that the connection portion is provided between the first conductive line and the second conductive line in the top plan view.

21. The electronic device according to claim 20, wherein the first and second conductive lines are configured to prevent current from flowing between the first point and the second point of the antenna element.

22. The electronic device according to claim 11, wherein the feeding point is provided between the first conductive line and the third conductive line.

23. The electronic device according to claim 20, further comprising:

a third conductive line connecting a third point of the antenna element to ground, wherein the feeding point is provided between the first conductive line and the third conductive line.

* * * * *